US005377089A

United States Patent [19]

Miller

[11] Patent Number: 5,377,089

[45] Date of Patent: Dec. 27, 1994

[54] LIGHT PROJECTOR WITH VIBRATION ISOLATING CHASSIS

[76] Inventor: Jack V. Miller, 700 N. Auburn Ave., Sierra Madre, Calif. 91024

[21] Appl. No.: 28,295

[22] Filed: Mar. 9, 1993

[51] Int. Cl.[5] ..... F21M 1/00; F21V 15/04; F21V 29/00

[52] U.S. Cl. ..... 362/373; 362/294; 362/362; 362/390; 362/375; 362/369

[58] Field of Search ..... 362/32, 294, 363, 373, 362/390, 362, 375, 369; 353/57, 119

[56] References Cited

U.S. PATENT DOCUMENTS

| | | | |
|---|---|---|---|
| 3,018,364 | 1/1962 | Wenman | 362/369 |
| 4,531,179 | 7/1985 | Baker | 362/363 |
| 4,546,420 | 10/1985 | Wheeler et al. | 362/276 |
| 4,613,931 | 9/1986 | Messinger | 362/373 |
| 5,055,697 | 10/1991 | Manoogian et al. | 362/294 |
| 5,243,500 | 9/1993 | Stephenson et al. | 362/32 |
| 5,295,056 | 3/1994 | Peck | 362/362 |

*Primary Examiner*—Ira S. Lazarus
*Assistant Examiner*—L. Heyman

[57] ABSTRACT

A light projector includes a lamp on an optical axis, energized from a remote source of electrical power and focussing illumination at an image plane. The lamp is disposed within a housing having a fan drawing cooling air into the housing through one or more inlets and expelling air through an outlet vent. A chassis within the housing supports the lamp and the fan. The chassis, including the lamp, fan, and a connector to the remote source of electrically power is removable from the housing. In a preferred embodiment, resilient vibration isolation mounting is provided between the lamp and the chassis and between the fan and the chassis, whereby the lamp is substantially isolated from fan vibration.

20 Claims, 1 Drawing Sheet

LIGHT PROJECTOR WITH VIBRATION ISOLATING CHASSIS

BACKGROUND OF THE INVENTION

This invention applies to the field of illumination projectors, including fiber optic projectors, slide projectors, video projectors, movie projectors and overhead slide projectors. These projectors normally use low-voltage (12 to 15 volt) quartz-halogen lamps operating at color temperatures above 3100° K. Lamps operated in projectors usually have a relatively short operating life.

Currently known prior-art projectors are difficult to service. Since lamp failures often occur while the lamp is hot, and the user must allow the projector to cool before attempting lamp replacement. Then, after cool-down, access to the lamp is usually through some kind of door. Since lamp pins fit tightly into the lamp socket receptacles, the lamps require substantial force and dexterity to remove, particularly when manipulated through a door opening. Then the new lamp must be inserted through the same doorway, but with the warning restriction that touching the quartz bulb with the fingers will cause premature lamp failure.

Once installed, quartz-halogen lamps are intensely hot, requiring a cooling fan to keep lamp seal temperatures within operating limits. This lamp cooling requirement is addressed by the applicant's U.S. Pat. Nos. 5,099,399 and 5,263,874. The Lamp filament is supported within the lamp envelope or "bulb".

Most projector manufacturers, as well as users, tend to rely on the lamp manufacturers' data on expected lamp life. However, lamp life tests are conducted on a stationary test bench at standard room temperature. The test lamps are operated at rated D.C. voltage to determine the published average number of burning hours before failure.

Test bench lamp failures occur as a tiny imperfection in the tungsten filament causes higher local resistance and higher heat than adjacent filament areas. Therefore, the filament spalls off tungsten atoms from the hottest spot, developing "notching" that eventually results in what is known as a "burned-out" lamp filament. However, projection lamps are not operated on a vibration-free test bench at room temperature and rated D.C. voltage. Instead, they are operated at low-voltage alternating current, much higher ambient temperature, in a housing with a vibrating fan that sweeps the potential resonant frequencies of the housing, the chassis, the lamp bracket and the lamp filament each time the fan starts or stops.

Extensive testing of lamps in fan-cooled projectors by the applicant has shown that the lamps normally do not operate long enough for typicalnotching failures to occur. Lamps that are rated for 1,000 hours fail in as little as 250 hours, and they fail in a different mode. The filament failure mode for fan-cooled projector lamps is a premature failure in which the filament support wires break off at their juncture with the glass bulb. The premature lamp failure is caused by the fan-induced vibration of the hot lamp filament supports.

A principal disadvantage of prior art projectors is that they do not recognize vibration as a primary cause of lamp failure, and hence to not provide isolation between the vibrating fan and the vibration-sensitive lamp. It is therefore a rare occasion when projector lamp life approaches the published lamp life. Another disadvantage of prior-art projectors is that the frequent lamp replacement is made quite difficult by the limited access through an access door.

Extensive tests by the applicant has shown that vibration isolation of the lamp from the fan can substantially eliminate filament vibration and restore projection lamp life to approximately the bench-test life published by the lamp manufacturer.

The primary purpose of the present invention is to provide a light projector in which the lamp is supported on a chassis that is easily removed from the projector housing for service and lamp replacement. It is a further purpose of the invention to a projector in which the lamp is isolated from fan vibration; thereby greatly increasing actual lamp life in service. It is yet another purpose of the invention to a projector in which all the electrical components of the projector are mounted on an easily-replaced chassis, facilitating on-site service, wherein all service, including lamp replacement may be done on a bench.

SUMMARY OF THE INVENTION

The achievement of the foregoing purposes of the invention is accomplished by the preferred embodiment of the present invention in which a housing is generally tubular and includes a first end including a light-emitting aperture and a fan air inlet, a second end including a fan air outlet. A removable chassis extends from the first end to the second end of the housing and also includes an electrical conductor connecting the lamp to an external source of electrical power. The removable chassis, including the lamp, fan, vented closure and electrical conductor, is easily removable from the second end of the housing.

DETAILED DESCRIPTION OF THE DRAWINGS

Figures 1, 2, 3, 4:
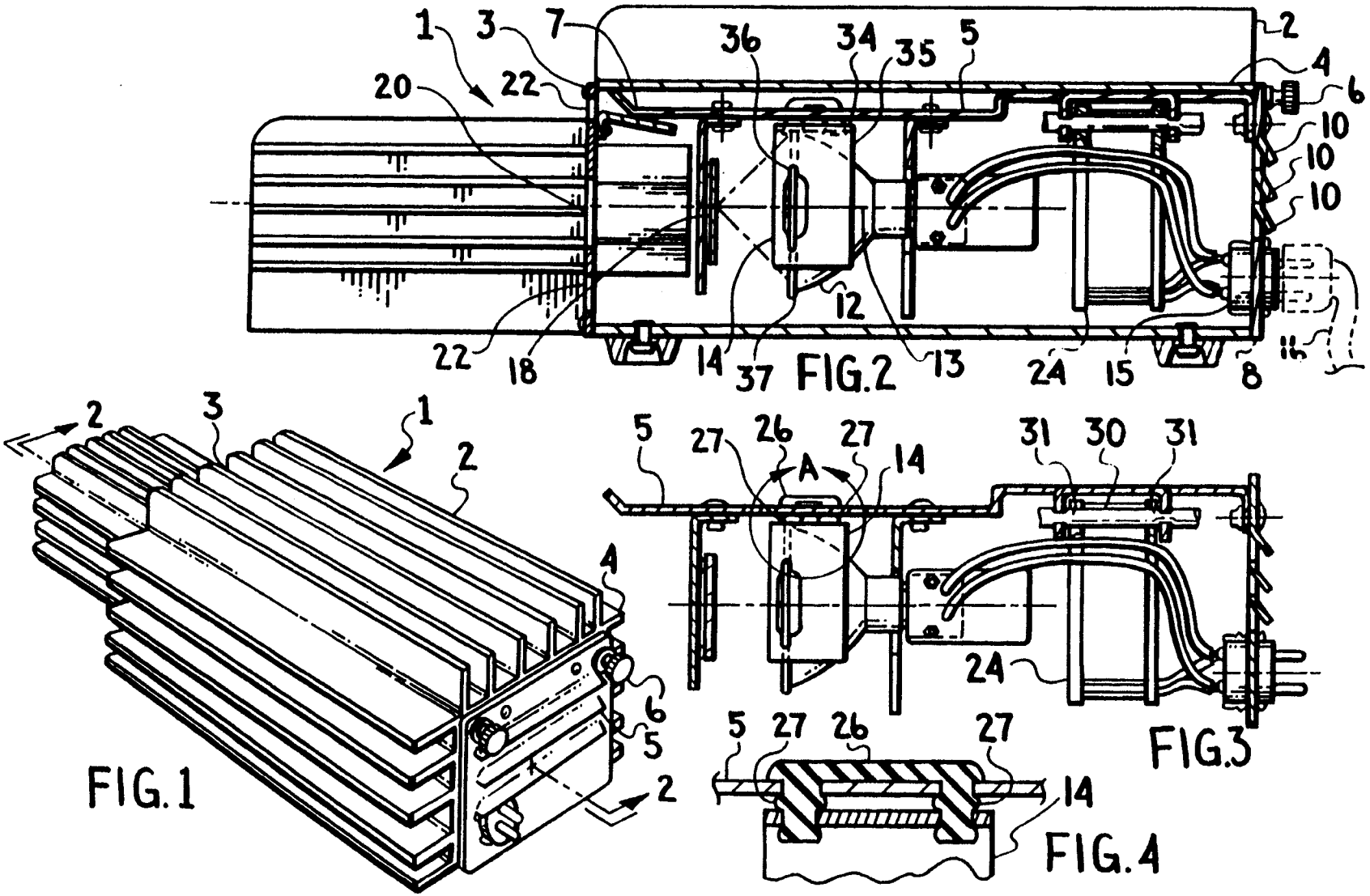
FIG. 1 is a perspective view of a projector according to the present invention.
FIG. 2 is a longitudinal cross-sectional view of the projector of FIG. 1, taken along section line 2—2.
FIG. 3 is a cross-sectional elevation view of the chassis of the light projector of FIG. 1, removed from the housing.
FIG. 4 is an enlarged section of view A of FIG. 2.

In FIG. 1 a light projector is shown having a housing 2 having a first end 3 and a second end 4. A chassis 5 is shown at the second end 4, and retained therein by fasteners 6.

In FIG. 2 a light projector 1 is shown including chassis 5 within housing 2, having a first end 7 at the first end 3 of the housing 2 and a second end 8 substantially closing the second end 4 of the housing 2. Chassis second end 8 includes one or more cooling air outlet vents 10, which comprise a plurality of ventilation louvers that permit expelling of air but substantially block the passage of light.

Chassis 5 supports a lamp 12 , shown as a reflector lamp held on an optical axis 13 by a lampholder bracket 14. Lamp 12 is energized through a connector 15 from a remote source of electrical power from a cord 16 (shown in phantom). Lamp 12 focusses illumination at an image plane 18. Housing 2 first end 3 includes an optical aperture 20 and one or more cooling air inlets 22. A fan 24 is attached to chassis 5 and is energized from the remote source of electrical power. Fan 24 draws cooling air through the air inlets 22 in the first end 3 of housing 2 and expels air through the cooling air outlet vents 10 of the second end of chassis 5. Means shown as thumb screws 6 removably fasten the second end 8 of chassis 5 to second end 4 of housing 2.

As shown in FIG. 2 and FIG. 3, lampholder bracket 14 is attached to chassis 5 with a vibration isolation means 26 comprising a plurality of resilient fasteners 27 passing through mounting holes in the lampholder and through respective adjacent holes in the chassis. In FIG. 2 fan is attached to the chassis with a vibration isolation means 30 comprising a plurality of resilient fasteners 31 passing through mounting holes in the fan and through respective adjacent holes in the chassis. Vibration isolation means 26 and 30 as shown are molded of silicone rubber, but other resilient materials, such as spring metals may be used.

Referring again to FIG. 2, lampholder bracket 14 mounting lamp 12 to chassis 5 comprises a resilient, generally U-shaped bracket having a base 34 and a pair of legs 35 holding a reflector rim 37 of lamp 12 in a slot 36 in each leg 35. Legs 35 are inwardly-biased for receiving a portion of reflector rim 37. The resilient U-shaped spring comprises an additional vibration isolating means for the reflector lamp.

The primary purpose of the present invention is accomplished by the light projector of the foregoing description and associated drawings, in which the lamp is supported on a chassis that is easily removed from the projector housing for service and lamp replacement. The chassis may be removed as soon a s failure occurs, without waiting for cooling, and replaced with a spare chassis. The failed lamp then can be replaced in its chassis with proper access. The invention also provides a projector in which the lamp is isolated from fan vibration; thereby greatly increasing actual lamp life in service.

I claim:

1. A light projector including:

a lamp on an optical axis, energized from a remote source of electrical power and having means for focussing illumination at an image plane;

a housing enclosing the lamp and having a first end including an optical aperture and one or more cooling air inlets, an open second end;

a chassis within the housing, having a first end at the first end of the housing and a second end substantially closing the second end of the housing, said chassis second end including one or more cooling air outlet vents therethrough;

a lampholder attached to the chassis and supporting the lamp;

a fan attached to the chassis, energized from the remote source of electrical power, said fan drawing cooling air through the air inlets in the first end of the housing and expelling air through the cooling air outlets of the second end of the chassis;

means for removably fastening the second end of the chassis to the second end of the housing; and means in the second end of the chassis for connecting the lamp and fan to the remote source of electrical power.

2. A light projector according to claim 1 in which the lampholder bracket is attached to the chassis with a vibration isolation means.

3. A light projector according to claim 2 in which the lampholder bracket vibration isolation means comprises a plurality of resilient fasteners passing through mounting holes in the lampholder bracket and through respective adjacent holes in the chassis.

4. A light projector according to claim 1 in which the fan is attached to the chassis with a vibration isolation means.

5. A light projector according to claim 4 in which the fan vibration isolation means comprises a plurality of resilient fasteners passing through mounting holes in the fan and through respective adjacent holes in the chassis.

6. A light projector according to claim 3 or 5 in which the resilient fasteners are made of silicone rubber.

7. A light projector according to claim 2 in which the vibration isolation means mounting the lamp to the chassis comprises a generally U-shaped lampholder bracket holding a rim of a reflector attached to the lamp, said bracket being mounted to the chassis by a plurality of resilient members passing through mounting holes in the lampholder bracket and through respective adjacent holes in the chassis.

8. A light projector according to claim 7 in which the lampholder bracket is a resilient, U-shaped spring having a flat base including a slot for receiving a portion of a rim on the reflector and two upstanding and inwardly-biased legs, each having a slot therein for receiving a portion of the reflector rim, wherein the resilient U-shaped spring comprises an independent vibration isolating means for the reflector lamp.

9. A light projector according to claim 1 in which the means connecting the lamp and fan to the remote source of electrical power comprises an electrical connector adapted to receive power from a flexible supply cord.

10. A light projector according to claim 1 in which the cooling air outlets of the second end of the chassis comprise a plurality of ventilation louvers that permit expelling of air but substantially block the passage of light.

11. A light projector including:

a generally tubular housing having a first end including an optical aperture and one or more cooling air inlets, and an open second end;

a chassis within the housing, having a first end at the first end of the housing and a second end substantially closing the open second end of the housing, said chassis second end including one or more cooling air outlet vents therethrough;

a lamp in a lampholder, attached to the chassis and supporting a lamp on an optical axis, said lamp energized from a remote source of electrical power and having means for focussing illumination at an image plane at the first end of the chassis;

a fan attached to the chassis, energized from the remote source of electrical power, said fan drawing cooling air through the air inlets in the first end of the housing and expelling air through the cooling air outlets of the second end of the chassis;

means for removably fastening the second end of the chassis to the second end of the housing and removing the chassis from the housing by unfastening said second end of the chassis from the housing and sliding the chassis out of the second end of the housing; and means in the second end of the chassis for connecting the lamp and fan to the remote source of electrical power.

12. A light projector according to claim 11 in which the lampholder bracket supports the rim of a reflector lamp and said bracket is attached to the chassis with a vibration isolation means.

13. A light projector according to claim 12 in which the lampholder bracket vibration isolation means comprises a plurality of resilient fasteners passing through mounting holes in the lampholder bracket and through respective adjacent holes in the chassis.

14. A light projector according to claim 11 in which the fan is attached to the chassis with a vibration isolation means.

15. A light projector according to claim 14 in which the fan vibration isolation means comprises a plurality of resilient fasteners passing through mounting holes in the fan and through respective adjacent holes in the chassis.

16. A light projector according to claim 13 or 15 in which the resilient fasteners are made of silicone rubber.

17. A light projector according to claim 12 in which the vibration isolation means mounting the lamp to the chassis comprises a generally U-shaped lampholder bracket holding a rim of a reflector attached to the lamp, said bracket being mounted to the chassis by a plurality of resilient members passing through mounting holes in the lampholder bracket and through respective adjacent holes in the chassis.

18. A light projector according to claim 17 in which the lampholder bracket is a resilient, U-shaped spring having a flat base including a slot for receiving a portion of a rim on the reflector and two upstanding and inwardly-biased legs, each having a slot therein for receiving a portion of the reflector rim, wherein the resilient U-shaped spring comprises an independent vibration isolating means for the reflector lamp.

19. A light projector according to claim 11 in which the means connecting the lamp and fan to the remote source of electrical power comprises an electrical connector adapted to receive power from a flexible supply cord.

20. A light projector according to claim 11 in which the cooling air outlets of the second end of the chassis comprise a plurality of ventilation louvers that permit expelling of air but substantially block the passage of light.

* * * * *